US005323498A

United States Patent [19]

Fellay et al.

[11] Patent Number: 5,323,498

[45] Date of Patent: Jun. 28, 1994

[54] BEDRIDDEN PATIENT HANDLING AID

[75] Inventors: Gilbert Fellay, Villars-sur-Glane; Francine Zuercher, Fribourg; Pierre Vuilleumier, Gletterens; Gilbert Widmer, Le Landeron, all of Switzerland

[73] Assignee: Ciposa Microtechniques S.A., Switzerland

[21] Appl. No.: 984,429

[22] PCT Filed: Jul. 2, 1992

[86] PCT No.: PCT/CH92/00133

§ 371 Date: Feb. 24, 1993

§ 102(e) Date: Feb. 24, 1993

[87] PCT Pub. No.: WO93/00874

PCT Pub. Date: Jan. 21, 1993

[30] Foreign Application Priority Data

Jul. 5, 1991 [FR] France ..... 91 08655

[51] Int. Cl.[5] ..... A61G 7/10

[52] U.S. Cl. ..... 5/86.1; 5/83.1

[58] Field of Search ..... 5/81.1-89.1

[56] References Cited

U.S. PATENT DOCUMENTS 3,015,114 1/1962 Seib ..... 5/86.1

FOREIGN PATENT DOCUMENTS 2565817 12/1985 France ..... 5/81.1

2226004 6/1990 United Kingdom .

*Primary Examiner*—Alexander Grosz

*Attorney, Agent, or Firm*—Davis, Bujold & Streck

[57] ABSTRACT

A collapsible bedridden patient handling aid essentially consisting of a lifting device (10) comprising a frame (11), mounted on two pairs of wheels (12*a*, 12*b*) combined with retractable legs (17), and supporting a platform designed to be inserted between the patient (20) and the bed (21) to raise the patient and put him or her back down, said platform consisting of movable flat strips (14) mounted individually on a support (15) which is pivotable about a horizontal axis (16). A control unit is designed to control all the movements of said strips.

10 Claims, 4 Drawing Sheets

BEDRIDDEN PATIENT HANDLING AID

The present invention concerns an aid for handling bedridden patients comprising a lifting device, a platform supported by said lifting device designed to be inserted between the bed and the patient, and activating means to raise or lower said platform in order to lift the patient above the bed and then reposition the patient on the bed, wherein the platform comprises a series of individually movable flat strips.

Manipulating bedridden patients is one of the serious problems encountered in medical and elderly care facilities. Medical personnel must do this several times a day when administering treatment, as must the aides who bathe patients and perform other necessary tasks such as changing dressings, making the bed, etc. These jobs now require two people, and this creates problems recruiting and training personnel. In addition, this is difficult work requiring extraordinary strength and endurance.

Lifting devices to aid hospital workers already exist, consisting of a platform for raising the patient above the bed. However, these devices have the disadvantage of not allowing easy access to the patient's back when necessary.

The patient handling device described in U.S. Pat. No. 3,015,114 consists of a frame with two strips to support the patient, said strips being laterally retractable on either side of the patient. The frame, which is situated on either side of the bed, interferes with work, as workers can only access the patient from below and not from the side. It is also a cumbersome device which is complicated to position. It is a fixed unit with no mechanical controls for the strips; operation is entirely manual.

The device described in British Patent No. 2 226 004 consists of a strut supporting a certain number of incurved parallel strips, but it is impossible to use when lifting a patient from a conventional hospital bed. Furthermore, in order to avoid hurting the patient when the strips rub against his or her back, the patient must be lifted up so a strip can be pulled back. Thus, the device is impractical and lacks utility. Finally, because of the way the strips are shaped, the device is especially awkward.

The present device proposes a practical solution to these problems and a remedy for the chronic shortage of health care workers, while at the same time alleviating the work of aides who nevertheless remain indispensable for handling bedridden patients.

To achieve this, the device according to the invention is characterized in that the movable strips are associated with a first mechanical means for displacing them axially, in an essentially horizontal direction, and a second mechanical means causing them to pivot about a horizontal axle.

In an advantageous embodiment the first mechanical means for axially displacing the movable strips comprises at least one friction device driven by an electric motor which is maintained in contact with one of the strip surfaces.

Each strip is preferably associated with a friction device independently driven by an electric motor; said friction device may comprise at least one ring attached to a peripheral groove on a rotating drum disposed beneath the strip.

In the preferred embodiment, the drum comprises a plurality of rings attached to peripheral grooves and in addition, the strip simultaneously contacts a first roller located above the strip and a second roller located below said strip.

In a particularly advantageous embodiment, said second mechanical means for making each strip pivot about a horizontal axle consists of an electric motor, an endless screw attached to the motor shaft and a gear engaging said endless screw and which is integral with a pivoting axle supporting a drum to which said strip is attached.

Advantageously, the drum of the second mechanical means supports the drum, the first roller and the second roller which serve as supports for the strip of the first mechanical means.

In another embodiment, the second mechanical means for displacing the movable strips along a generally horizontal axle may consist of hydraulic or pneumatic cylinders respectively associated with said movable strips.

For safety reasons the movable strips are designed to prevent two juxtaposed strips from being moved simultaneously.

In the preferred embodiment, the friction device preferably comprises at least one ring located in the peripheral grooves of a rotatable drum situated below the strips.

The present invention will be better understood with reference to the drawing, wherein.

Figure 1:
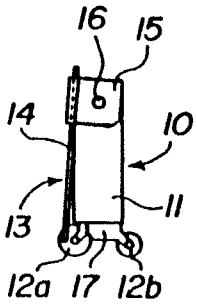
FIG. 1 is a schematic elevation of the device when folded up.
Figure 2:
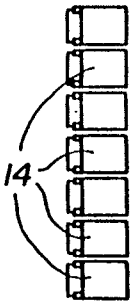
FIG. 2 is the same device in the same state, seen from above.

With reference to FIGS. 1 and 2 the patient handling aid as shown consists essentially of a lifting device 10 comprising a frame 11 mounted on two pair of wheels 12*a*, 12*b* and supporting a platform 13 which consists, in the present case, of seven flat strips 14 individually attached to a support 15 pivotable about a horizontal axle 16. A control box CB (FIG. 15) is designed to control strip displacement. It may be part of the device or it may be independent. As shown in FIG. 1, the device can be folded up to reduce its bulk. In this position strips 14 comprising platform 13 are folded downward and the pair of wheels 12b attached to retractable leg 17 is located essentially beneath frame 11.

Figure 3:
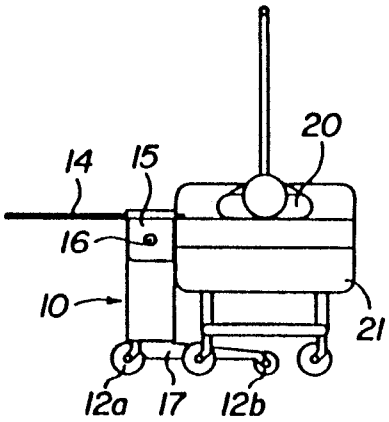
FIG. 3 is a schematic elevation of the device according to the invention prepared for use.
Figure 4:
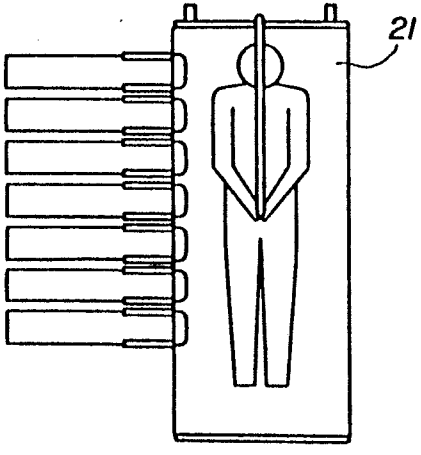
FIG. 4 is the device of FIG. 3 seen from above.

FIGS. 3 and 4 show the device ready for use during a procedure on a patient 20 lying on a hospital bed 21. In this position platform 13 has been raised and leg 17 extended so that both pairs of wheels 12a and 12b form a stable base for the entire unit. Notice that strips 14 which had been previously raised and assumed a horizontal position are temporarily directed toward the outside of bed 21.

Figure 5:
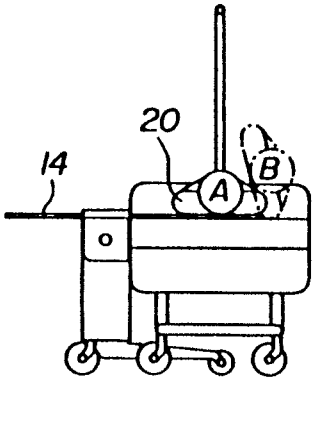
FIG. 5 is an elevational view of the device during the first actual phase of usage.

The device shown in FIG. 5 shows one phase of use in which the patient 20 has been rolled to his or her side by a nurse or an aide from position A to position B, thereby allowing strips 14 comprising platform 13 to be placed on the bed so the patient can resume the initial position on platform 13 rather than on the bed. This position is shown in FIG. 6 depicting strips 14 which form a platform 13 serving as a support for patient 20.

Figure 7:
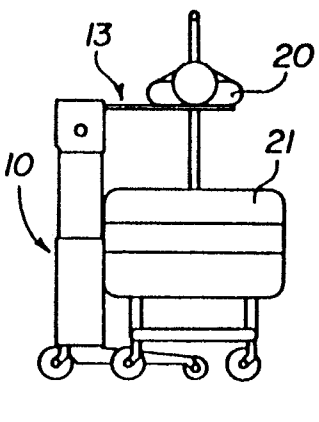
FIG. 7 is an elevational view of the device during the second phase of use.
Figure 8:
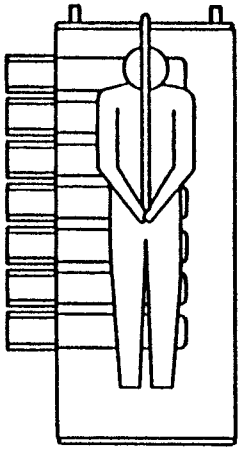
FIG. 8 is the device during the same phase, seen from above.
Figure 6:
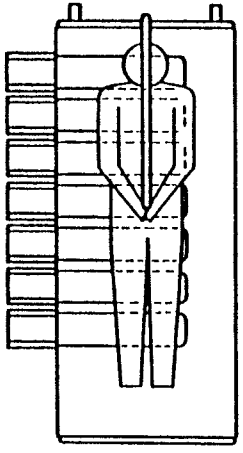
FIG. 6 is the device during the same phase seen from above.

The following step is shown in FIGS. 6 and 7, which show patient 20 upon platform 13 which has been raised by lifting device 10. In this position, the patient is supported entirely by platform 13 more than twenty centimeters above the bed 21 so the worker can do whatever is necessary to the bed, i.e., make the bed, disinfect it, etc. FIGS. 6 and 8 are virtually identical because when viewed from above, patient 20 occupies the same position when platform 13 is lowered as in FIG. 5, or raised as in FIG. 7.

Figure 9:
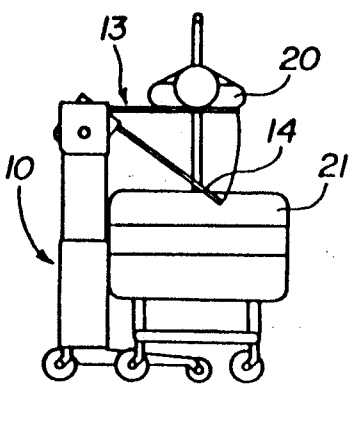
FIG. 9 is an elevation of the device during a third phase of use.
Figure 10:
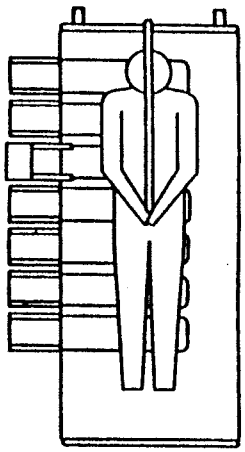
FIG. 10 is the device during the same phase, seen from above.
Figure 15:
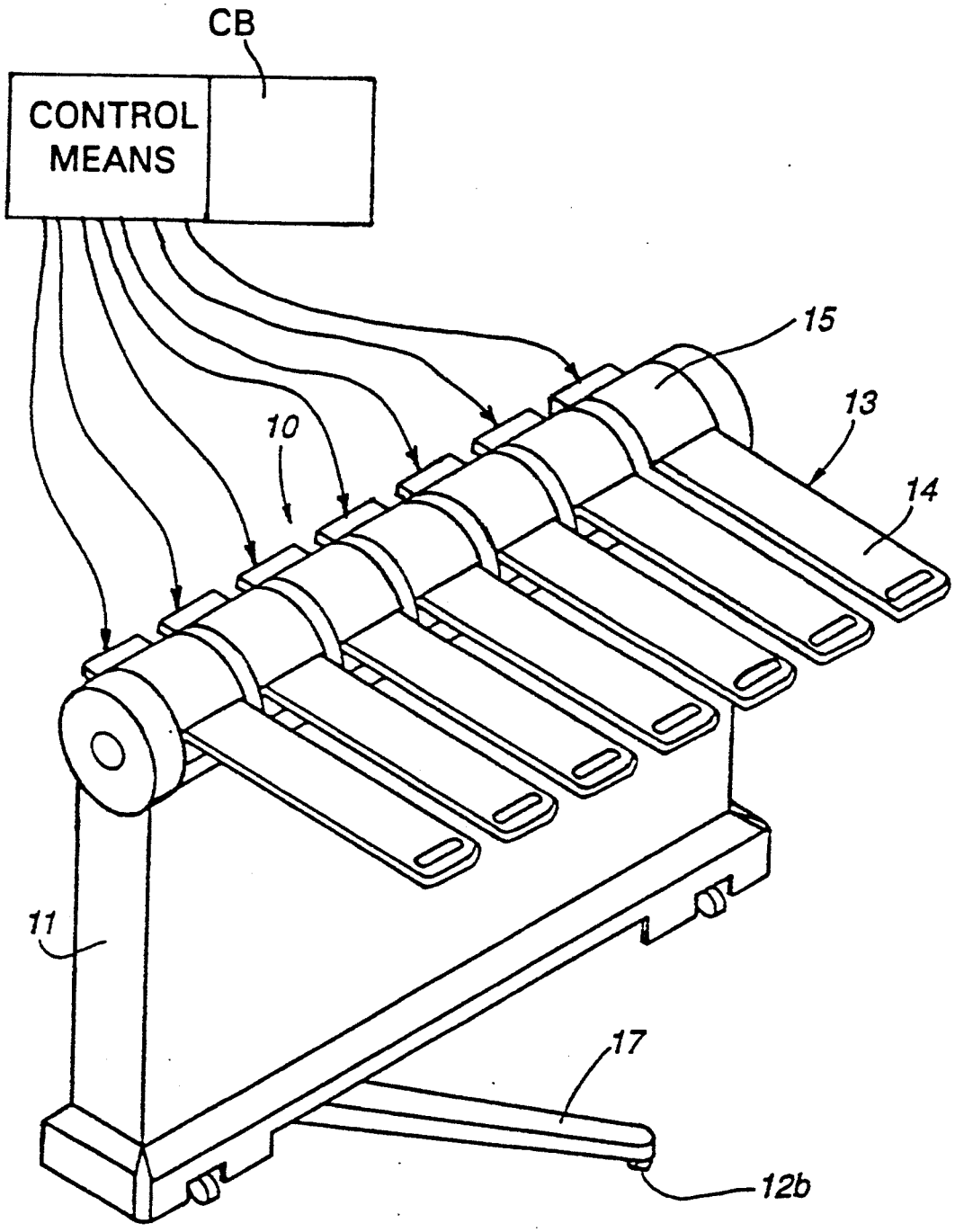
FIG. 15 is a perspective view of the lifting device.

FIGS. 9 and 10 show a specialized use of platform 13 supporting patient 20. Since strips 14 are independent of one another, one or more of these strips can be pivoted so the nurse or aide has direct access to the patient's back for personal hygiene tasks, for example. If one or more strips 14 are pivoted as shown in FIG. 9, the patient is supported by the other strips which remain in a horizontal position, resulting in one area being freed for the medical worker's interventions. For safety reasons, two juxtaposed strips cannot be pivoted simultaneously. As seen in FIG. 15, control means can be used to prevent two juxtaposed movable strips from moving simultaneously.

It is obvious that this patient handling device is particularly beneficial because it allows a nurse or aide to perform alone tasks which formerly required two persons working simultaneously with a patient. Furthermore, this device relieves the nurses and aides, as jobs requiring physical strength such as lifting patients are performed mechanically.

Figure 11:
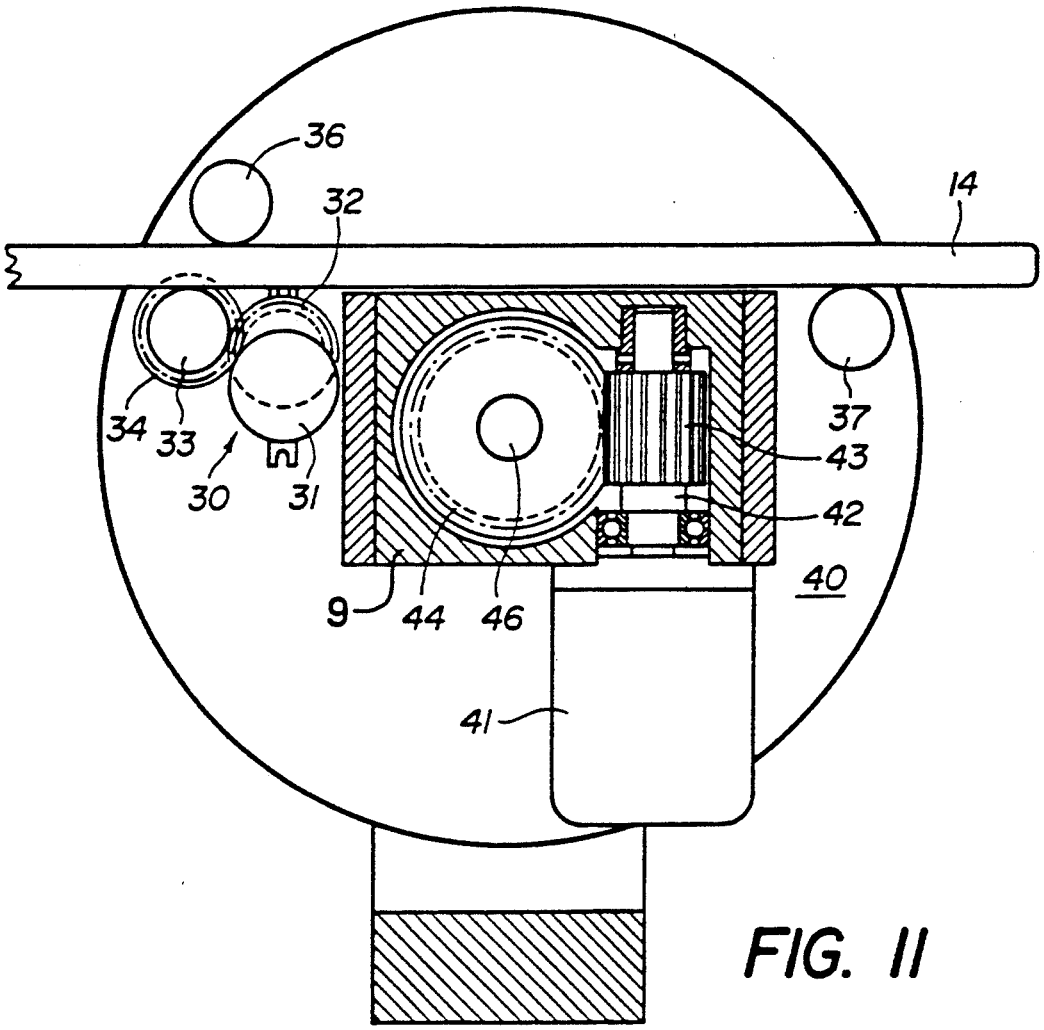
FIG. 11 is a profile partially illustrating the first mechanical means for axially displacing the platform and the second mechanical means which makes it pivot.
Figure 12:
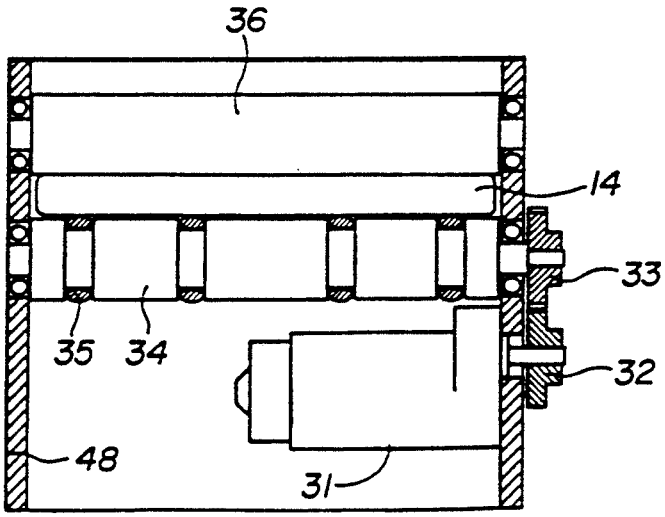
FIG. 12 is a frontal view of said first means.
Figure 13:
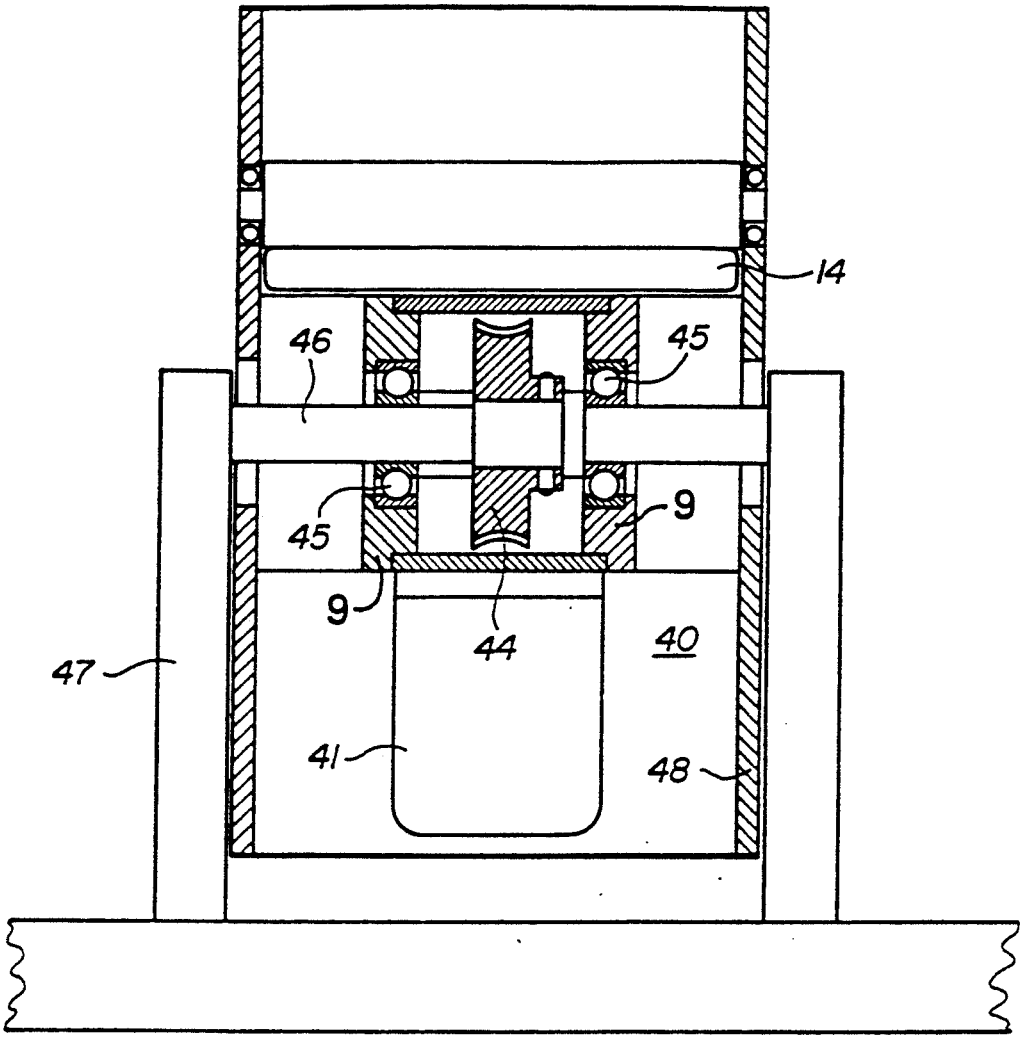
FIG. 13 is an elevational view of the second means which causes the strips on the platform to pivot.
Figure 14:
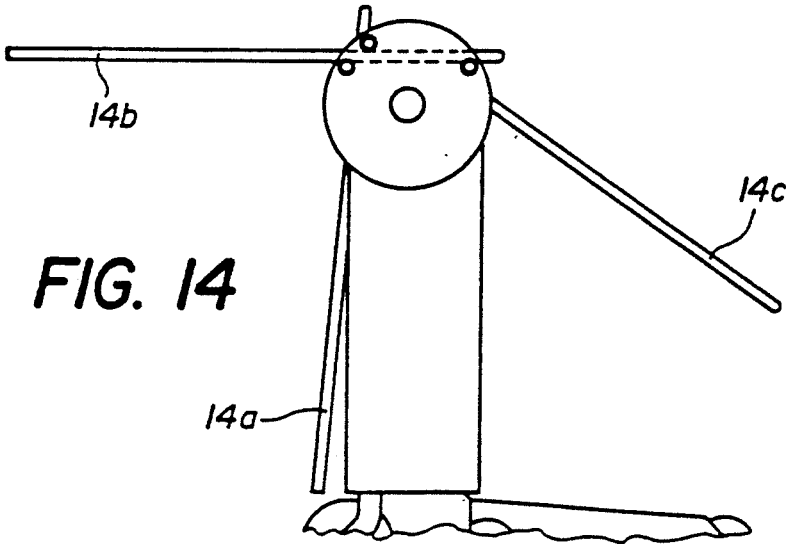
FIG. 14 is a schematic illustration of how the elements shown in FIG. 13 function.

In order to perform the various functions described above, strips 14 are individually associated with a corresponding first mechanical means 30 which displaces each strip in an axial direction, said mechanical means being shown in detail in FIGS. 11 and 12, and a corresponding second mechanical means 40 which makes the strips pivot about a horizontal axle, said mechanical means being represented in detail in FIGS. 11 and 13. FIG. 14 shows how the second mechanical means functions.

With reference to these drawings, the first mechanical means essentially comprises an electric motor 31, the output shaft of which supports a drive pinion 32 which engages a second drive pinion 33 attached to the end of a drum 34. This cylindrical drum has a certain number of friction elements in the form of rings 35, preferably consisting of elastomeric toric connections located inside peripheral grooves within drum 34. Rings 35 contact the lower surface of a strip 14 maintained in position by a first roller 36 which is located above and in contact with the upper surface of this strip and a second roller 37 in contact with its lower surface, at a point far enough away from roller 36 that the strip resists the weight of a patient positioned on platform 13.

The second mechanical means 40 consists of an electric motor 41, the output shaft 42 of which has an endless screw 43 engaging a gear 44 attached to a pivotable shaft 46 (see FIG. 13). Motor 41 is attached to support 9 which is connected to pivotable shaft 46 by means of two rollers 45. Shaft 46 is held by one or two supports 47 integral with lifting device 10. This unit is mounted inside drum 48 which serves as a support for the first mechanical means 30 as well as for rollers 36 and 37. Because of this, since motor support 9 is fixed and the drum which also holds strip 14 is movable about pivotable axle 46, the strip can be rotated in different positions.

FIG. 14 shows the three positions which strips 14 can assume. These three positions correspond in use to three positions of drum 48 which are controlled by motor 41 through endless screw 43 and gear 44. In a first position 14a, the strips are folded downward. This position corresponds to that described in FIG. 1. In a second position, the strips are horizontally straightened but directed toward the outside of the usage area. In this position strips 14b correspond to the state of the device as described with reference to FIG. 3. Finally, in a third position, strips 14c are directed toward the bottom at about 45° below the usage area. They correspond to the state of the device as shown in FIG. 9.

Strips 14 can also be moved with the use of hydraulic or pneumatic cylinders (not shown) associated with each strip on platform 13.

The present invention is not limited to the embodiments described, but may undergo various modifications and assume various forms obvious to one skilled in the art.

We claim:

1. A device for handling a bedridden patient comprising:

a lifting device (10);

a platform (13) supported by said lifting device for lifting the patient, said platform comprising a series of flat individually movable strips (14) aligned along a horizontal axis;

means for at least one of raising and lowering said movable strips for at least one of lifting the patient from a bed and lowering the patient onto a bed;

first mechanical means (30) for moving each said movable strip substantially perpendicular to said horizontal axis; and second mechanical means (40) for rotatably pivoting each said movable strip about said horizontal axis.

2. The device according to claim 1, wherein each said movable strip has a said first mechanical means (30) and a said second mechanical means (40) individually associated therewith.

3. The device according to claim 1, wherein said first mechanical means comprises at least one friction device drivingly connected to an electric motor (31), and said at least one friction device is maintained in contact with at least one said movable strip.

4. The device according to claim 3, wherein each said movable strip has a separate friction device drivingly connected to a separate electric motor.

5. The device according to claim 4, wherein each said friction device comprises at least one ring (35) located in a peripheral groove of a rotatable drum (34) and in contact with a first surface of a said movable strip.

6. The device according to claim 5, wherein each said movable strip has a second surface which contacts a first roller (36) and said first surface contacts a second roller (37).

7. The device according to claim 1, wherein said second mechanical means comprises an electric motor (41) which has a rotatable shaft (42), an endless screw (43) is supported adjacent one end of said rotatable shaft (42), a gear (44) is engaged with said endless screw (43), said gear (44) is connected to a shaft (46) that supports a rotatable first drum (48), one of said movable strips is supported by said first drum (48), and said motor facilitates individual pivotable movement of that supported movable strip about said shaft (46) supporting said first drum (48).

8. The device according to claim 7, wherein said first drum supports a second drum (34), a first roller (36) and a second roller (37), and said first and second rollers (36, 37) contact opposed surfaces of one said movable strip.

9. The device according to claim 1, further comprising control means connected to said device for preventing two juxtaposed said movable strips from moving simultaneously with one another.

10. A device for handling a bedridden patient comprising:

a lifting device (10);

a platform (13) supported by said lifting device for lifting the patient, said platform comprising a series of flat individually movable strips (14) aligned along a horizontal axis;

means for at least one of raising and lowering said movable strips for at least one of lifting the patient from a bed and lowering the patient onto a bed;

each said movable strip having first mechanical means (30) drivingly connected therewith for moving that said movable strip substantially perpendicular to said horizontal axis, and each said movable strip having second mechanical means (40) drivingly connected therewith for rotatably pivoting that said movable strip about said horizontal axis.

* * * * *